United States Patent [19]

Whitlock

[11] 4,117,977

[45] Oct. 3, 1978

[54] HIGHWAY-RAILWAY CROSSING

[75] Inventor: Jacob O. Whitlock, Springfield, Ill.

[73] Assignee: Structural Rubber Products Company, Springfield, Ill.

[21] Appl. No.: 732,366

[22] Filed: Oct. 14, 1976

[51] Int. Cl.[2] ..... E01C 9/04

[52] U.S. Cl. ..... 238/8; 238/10 R

[58] Field of Search ..... 238/6–9, 238/10 R–10 F

[56] References Cited

U.S. PATENT DOCUMENTS

| | | | |
|---|---|---|---|
| 1,253,600 | 1/1918 | Johnson | 238/8 |
| 1,411,415 | 4/1922 | Cooley | 238/8 |
| 1,729,360 | 9/1929 | Price et al. | 238/8 |
| 1,827,823 | 10/1931 | Myers | 238/8 |
| 2,828,080 | 3/1958 | Rennels | 238/8 |
| 2,839,249 | 6/1958 | Curtis | 238/8 |
| 3,487,998 | 1/1970 | Farmer | 238/8 |
| 3,843,051 | 10/1974 | Whitlock | 238/8 |
| 3,866,830 | 2/1975 | Hein et al. | 238/8 |

FOREIGN PATENT DOCUMENTS

| | | | |
|---|---|---|---|
| 2,028,740 | 12/1971 | Fed. Rep. of Germany | 238/10 C |
| 2,135,202 | 2/1973 | Fed. Rep. of Germany | 238/10 E |
| 2,350,759 | 4/1975 | Fed. Rep. of Germany | 238/8 |

*Primary Examiner*—Robert G. Sheridan
*Assistant Examiner*—Carl Rowold
*Attorney, Agent, or Firm*—Neuman, Williams, Anderson & Olson

[57] ABSTRACT

A highway-railway crossing is provided wherein a pair of gage section units is disposed between the rails of a track and secured to the ties subtending and supporting the rails. A pair of side section units is also provided between which the rails and gage section units are disposed. Each side section unit has a peripheral portion thereof resiliently engaging the web section of a rail. Each gage section unit includes a resilient, moisture-proof upper lamina, and a plurality of elongated reinforcing elements arranged in laterally spaced substantially parallel relation and secured to the underside of the lamina. The gage section units are disposed in abutting side-by-side relation and span the distance between the rails. The gage section units have abutting inner faces provided with interfitting male and female segments forming an elongated moisture-proof joint.

15 Claims, 9 Drawing Figures

HIGHWAY-RAILWAY CROSSING

BACKGROUND OF THE INVENTION

Various highway-railway crossings have heretofore been provided; however, because of certain design characteristics they have been beset with one or more of the following shortcomings: (a) they are susceptible to rapid deterioration because of moisture accumulating beneath the ties at the crossing; (b) they are incapable of providing adequate drainage of the exposed surface thereby rendering said surface hazardous to both highway and railway traffic; (c) the crossing is difficult and awkward to construct and install and requires an inordinate amount of manual labor; (d) the crossing utilizes customized components which are designed to be disposed in precise locations, are not capable of being interchangeable or inverted with respect to other components, and/or are difficult to modify so as to compensate for physical variations encountered at the crossing site; (e) they are incapable of being utilized with a variety of highway constructions; and (f) they require costly and frequent maintenance and repair.

SUMMARY OF THE INVENTION

Thus, it is an object of the invention to provide an improved crossing which is not beset with any of the aforenoted shortcomings.

It is a further object of the invention to provide an improved crossing wherein rail chatter caused by railway traffic at the crossing is eliminated or reduced to a minimum.

It is a further object of the invention to provide an improved crossing which compensates for the undulating of the trackage caused by the railway rolling stock without adversely affecting the stability and securement of the improved crossing.

It is a still further object of the ivnention to provide an improved highway-railway crossing wherein proper rail gage is maintained notwithstanding that the crossing is subjected to a high volume of highway and railway traffic.

Further and additional objects will appear from the description, accompanying drawings and appended claims.

In accordance with one embodiment of the invention, a highway-railway crossing is provided which comprises a pair of rails arranged in a predetermined spaced, substantially parallel relation. The rails are subtended and supported by a plurality of ties disposed transversely of the rails and arranged in spaced substantially parallel relation. One or more pairs of elongated gage section units are disposed between the rails and span the distance therebetween. The gage section units of a pair are arranged in side-by-side relation and have elongated inner faces thereof in abutting face-to-face relation. Each gage section unit has an elongated outer face which engages a side of the web section of one of the rails. The inner faces of the gage section units have complementary male and female segments which interfit to form an elongated moisture-proof joint. Each gage section unit includes a resilient, moisture-proof, upper lamina and a plurality of elongated reinforcing elements arranged in laterally spaced, substantially parallel relation and affixed to the underside of the lamina. The gage section units are secured to certain of the ties by a plurality of fasteners disposed within depressions formed in the exposed surface of the lamina. The fasteners penetrate and are anchored to the portions of the ties disposed beneath and aligned with the depressions. The portion of each gage section unit adjacent the outer face thereof is provided with an elongated drain trough which is coextensive with the length of the unit, is spaced inwardly from the outer face, and is recessed a substantial amount from the exposed surface of the lamina. The depth of the trough is such as to accommodate the wheel flange of the railway rolling stock as the latter passes over the rails. The drain trough effects drainage endwise of the gage section units.

A pair of side section units is provided between which the rails and the gage section units are disposed. The side section units are secured to and supported by the ties. Each side section unit has an upper lamina of resilient, moistureproof material with an edge thereof adapted to resiliently engage a second side of a rail web section and thereby effect dampening of rail vibrations caused primarily by railway traffic. The upper lamina of each side section unit has secured to the underside thereof at least one elongated reinforcing element. The exposed upper surfaces of the gage section units and the side section units are disposed in substantially coplanar relation with the top surfaces of the rails.

DESCRIPTION

For a more complete understanding of the invention reference should be made to the drawings wherein.

Figure 1:
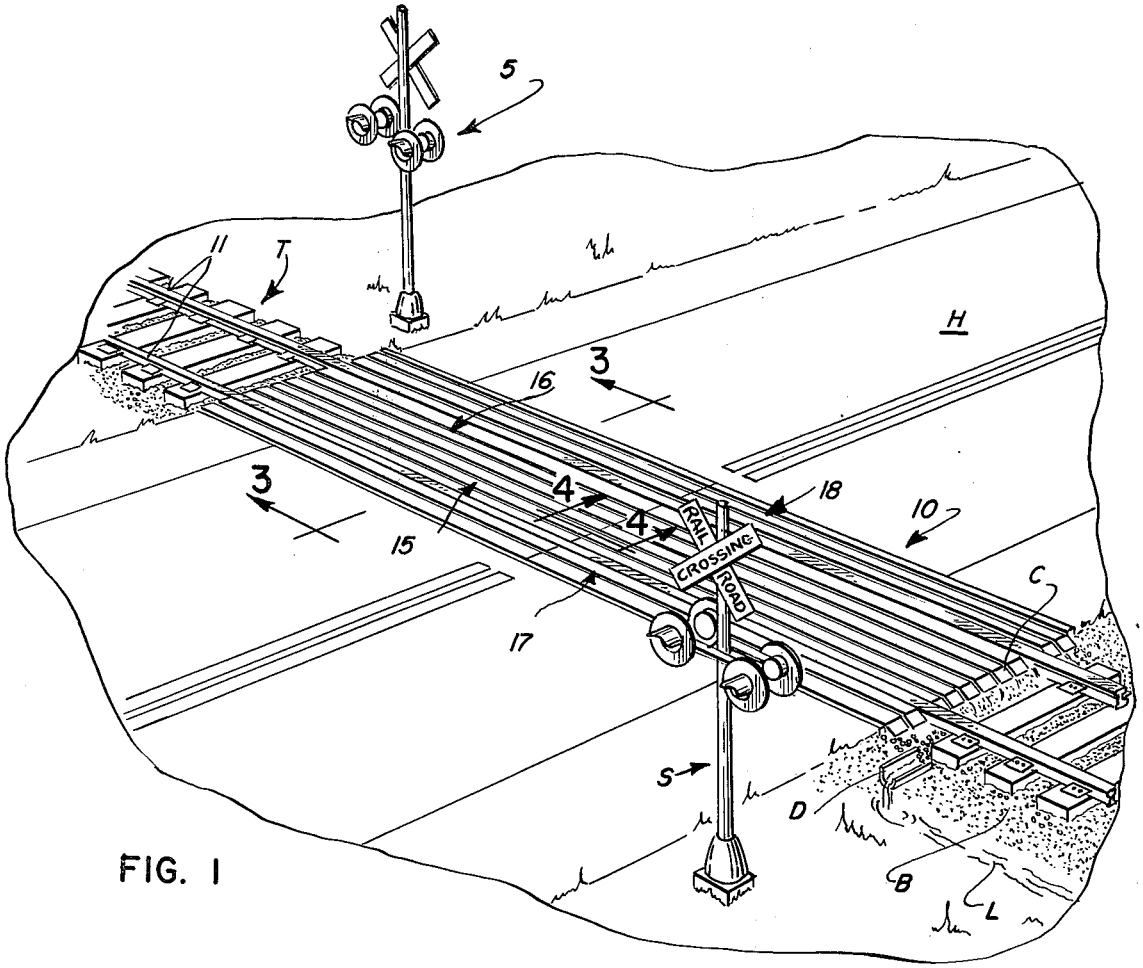
FIG. 1 is a fragmentary, top perspective view of one form of the improved crossing.

Referring now to the drawings and more particularly to FIG. 1, one form of the improved highway-railway crossing 10 is shown located at the intersection of a conventional railway track T and a highway or roadway H. As is customary, the intersection is delineated for the approaching motorists by automatic flashing signals, gates or the like S. While FIG. 1 shows only one track T intersecting the highway H, the crossing 10, to be hereinafter described, may be utilized where a plurality of tracks intersect the highway at a given location.

Figure 3:
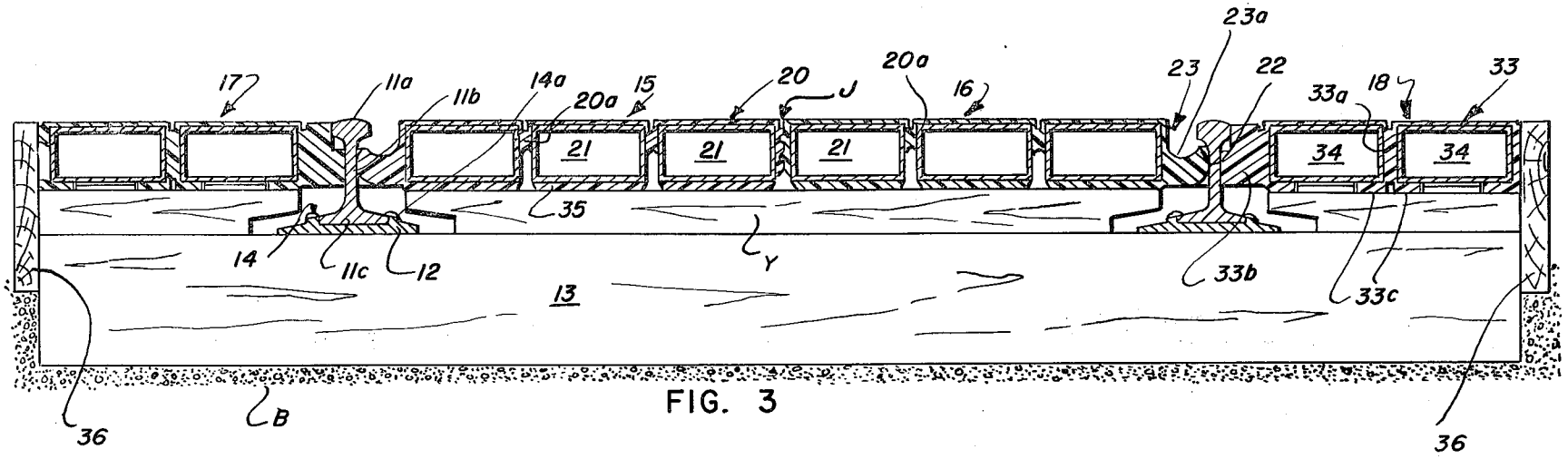
FIG. 3 is an enlarged, sectional view taken along line 3—3 of FIG. 1.

The conventional track T comprises a pair of rails 11 of like configuration, weight and size which are arranged in uniformly spaced, substantially parallel relation. The spacing between the pair of rails defines the gage of the track (e.g. standard gage — 4 feet 8½ inches). Each of the rails 11, as seen in FIG. 3, includes a head section 11*a*, which is engaged by flanged railway wheels, not shown; a web section 11*b* depending from the underside of the head section; and a base section 11*c* extending transversely from the bottom of the web section. The base section 11*c* rests upon a conventional tie plate 12 which in turn is subtended and supported by a wooden cross tie 13. The cross ties 13 are normally disposed in spaced (e.g. 20 inches C/L to C/L), substantially parallel relation and extend at right angles to the rails. The cross ties rest upon a subgrade of suitable ballast B, such as crushed stone or the like.

The rail base sections 11*c* and associated tie plates 12 are secured to the subtending cross tie 13 by a plurality of conventional spikes 14 which are driven into the cross tie 13. Suitable openings are provided in the tie plate to receive the shank of the spike. Each spike has an enlarged, exposed head 14*a* which has a peripheral portion thereof overlying and engaging a peripheral portion of the rail base section 11*c*.

The improved crossing 10 includes one or more pairs of gage section units 15, 16. The number of pairs of units 15, 16 required will depend upon the width of the intersecting roadway H including the shoulders thereof. A pair of units 15, 16 are disposed intermediate the rails 11 and, when in place, span the distance between the rails. In addition to the gage section units 15, 16 there are one or more pairs of side section units 17, 18, sometimes referred to as field section units. The rails and gage section units are disposed between the pair of side section units as seen more clearly in FIG. 3. The number of pairs of side section units 17, 18 utilized normally corresponds to the number of pairs of gage section units 15, 16 utilized in a particular installation.

Each gage section unit 15, 16 is of like construction and when they are installed between the rails 11, unit 15 is positioned in 180° relation with respect to unit 16. By reason of the units 15, 16 being of like configuration, installation of the improved crossing is greatly facilitated. In the preferred embodiment, the length of each unit 15, 16 is approximately 80 inches; thus, enabling each unit to normally span four cross ties. The length of unit 15, 16 may be greater or less, if desired, but should be a multiple of cross tie spacing for reasons to be hereinafter discussed. The overall width of each unit 15, 16 is preferably slightly more than one half the distance between the inner surfaces of the rail web sections 11*b* thereby effecting positive engagement between the outer surfaces of the gage section units and the rail web sections.

Figure 9:
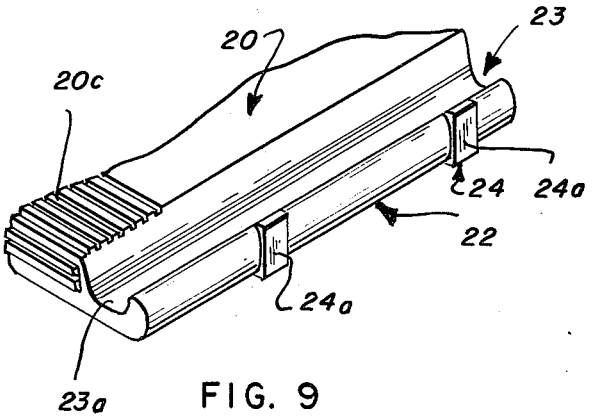
FIG. 9 is an enlarged, fragmentary, perspective view of the outer face of a gage section unit showing the elongated longitudinally extending drain trough formed in a portion of the unit adjacent the outer face thereof.

The unit 15, 16 includes a resilient moisture-proof lamina 20. Bonded or otherwise secured to the underside of the lamina are a plurality of elongated reinforcing elements 21. In the illustrated embodiment, the elements are of hollow tubular configuration and are formed of rigid metal or the like. Each element 21 extends substantially the full length of the unit and has the opposite ends thereof closed by header plates 21*a*, see FIG. 4. The elements 21 are arranged in spaced, substantially parallel relation and the upper portions of adjacent elements 21 are maintained in proper spaced relation by depending ribs 20*a* formed on the underside of lamina 20. Each unit 15, 16 has an elongated outer face 22 which is adapted to resiliently engage one side of the rail web section 11*b*, when the unit is in proper position between the rails 11. The portion 23 of the unit adjacent the outer face is recessed a substantial distance from the exposed upper surface of the lamina. Formed in the recessed upper surface of portion 23 is an elongated drain trough 23*a* which extends the full length of the unit. The depth of the trough is such that it will readily accommodate without obstruction the flange formed on a conventional railway wheel, not shown, when the railway rolling stock passes over the crossing 10. It should be noted that the drain trough 23*a* is self-contained within portion 23 and does not rely upon the engagement between the outer face 22 and the rail web section 11*b* to form the trough. As seen in FIG. 9, the outer surface 22 of the unit 15, 16 is provided with a plurality of longitudinally spaced stiffening pads 24, each of which has a flattened outer surface 24*a* adapted to resiliently contact the rail web section 11*b*. By reason of the pads 24 sagging of the portion 23 is avoided when the unit is in position between the rails.

Figure 6:
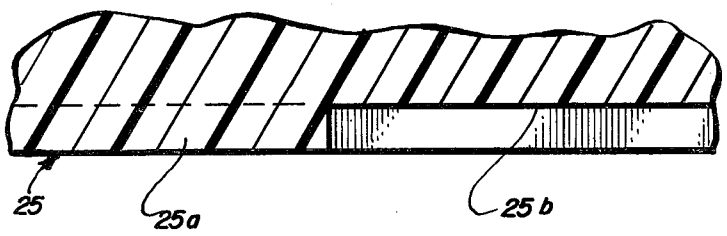
FIG. 6 is an enlarged, fragmentary, sectional view taken along line 6—6 of FIG. 5.
Figure 5:
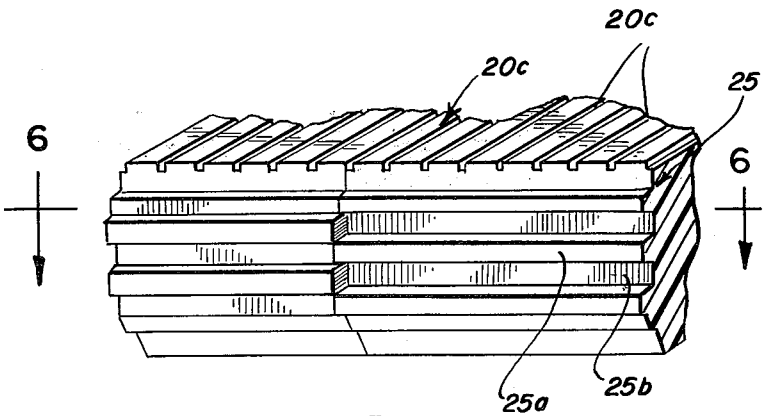
FIG. 5 is an enlarged, fragmentary, side elevational view of the inner face of one of the gage section units taken at substantially the mid-length of the unit where the male and female segments assume inverted relations.
Figure 7:
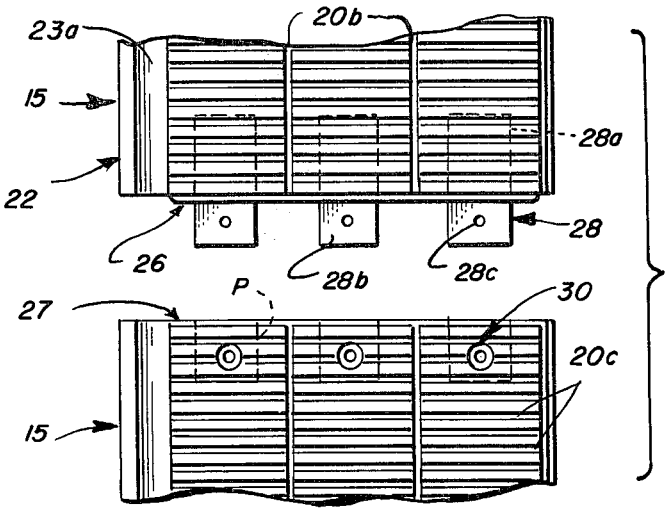
FIG. 7 is a fragmentary, top plan view of the interfitting end faces of a pair of longitudinally aligned gage section units prior to the latter being disposed in abutting relation.

The opposite or inner faces 25 of the units 15, 16 are disposed in abutting face-to-face relation when the units are placed in side-by-side relation so as to span the distance between the web sections of the rails. As seen in FIGS. 3, 5 and 6, the inner face 25 of the unit 15, 16 is provided with male and female segments 25*a* and 25*b*, respectively, which are adapted to interfit and form an elongated moisture-proof joint J between the units. The segments 25*a* and 25*b* in the illustrated embodiment are in the form of tongue and groove. At approximately mid-length of the unit, the segments 25*a* and 25*b* are inverted as seen more clearly in FIGS. 5 and 6. By reason of this arrangement, the units 15, 16 may be of the same construction and, when installed in the crossing, unit 15 will be disposed in a reversed (180°) relation with respect to unit 16, see FIG. 2.

The exposed surface of lamina 20 is provided with a first set of elongated grooves 20*b* which are disposed in spaced substantially parallel relation and extend longitudinally of the unit. A second set of short grooves 20*c* is also provided in the exposed lamina surface and intersect and interconnect with the first set of grooves 20*b*, as well as drain trough 23*a*. The first and second sets of grooves serve a dual function: (a) they provide effective traction for the highway vehicles passing over the crossing and (b) they facilitate drainage endwise of the units.

Figure 8:
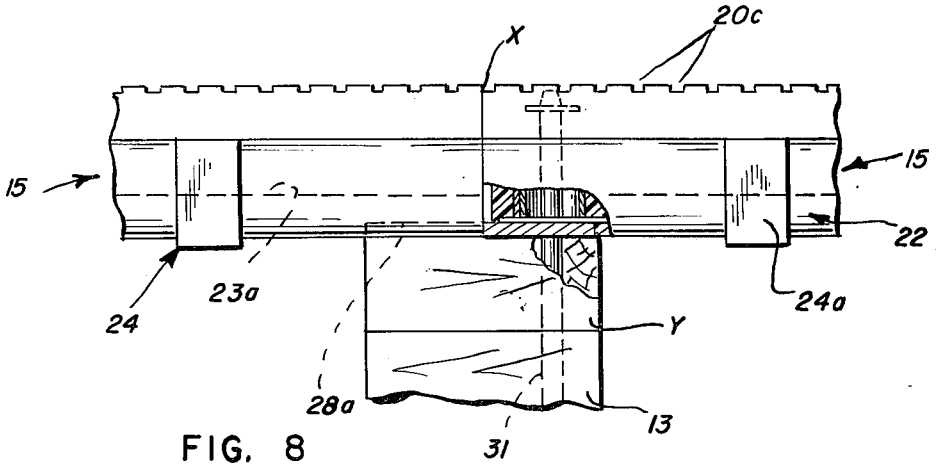
FIG. 8 is a fragmentary, elevational view of the outer faces of the gage section units disposed in abutting end-to-end relation; a portion of one unit being shown in partial section with an anchoring tab member protruding from the end face of one unit being disposed within a complemental pocket formed in the end face of the other unit.

As aforementioned, pairs of gage section units are normally disposed between the rails 11 and the corresponding units of the pairs are disposed in abutting end-to-end relation, see FIG. 8. The opposite end faces 26, 27 of each unit are provided with male and female segments 26*a*, 26*b* and 27*a*, 27*b* which extend crosswise of the end face and substantially the full width of the unit. The segments may be of tongue-and-groove configuration. The male and female segments at one end face are inverted with respect to the segments formed at the opposite end. Thus, when the end faces of adjacent units are disposed in abutting relation the segments will interfit and form a moisture-proof cross joint X.

Figure 4:
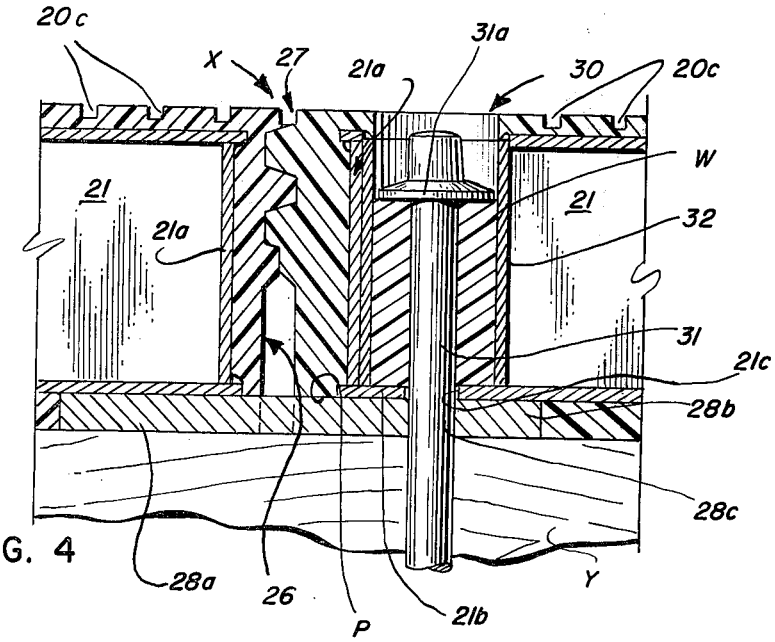
FIG. 4 is an enlarged, fragmentary, sectional view taken along line 4—4 of FIG. 1.
Figure 2:
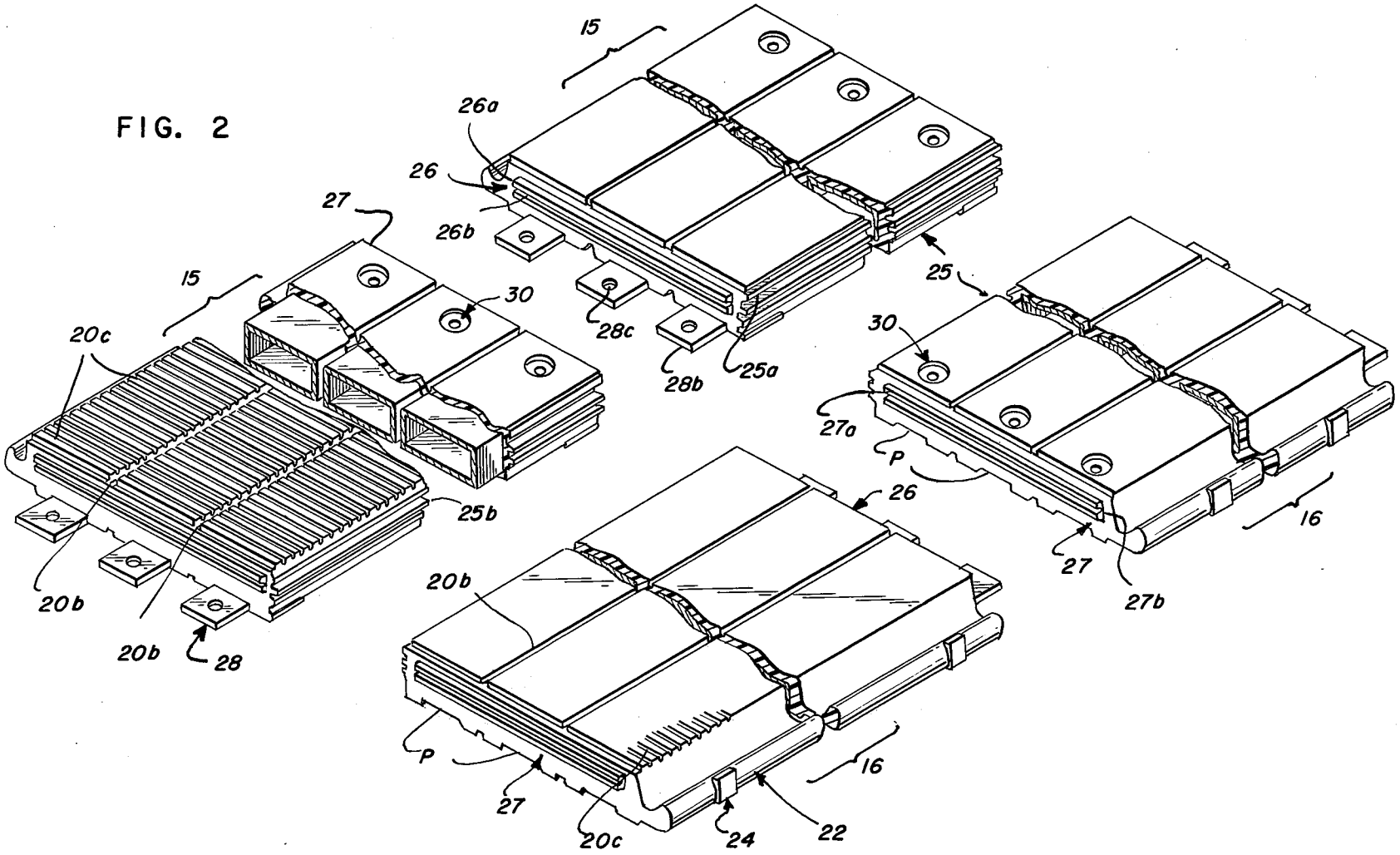
FIG. 2 is an exploded, enlarged, fragmentary, perspective view of pairs of gage section units shown in FIG. 1.

As seen in FIG. 2, one end face 26 of each unit is provided with a plurality of projecting anchoring tab members 28. The members are in laterally spaced relation and project longitudinally a like amount. As seen in FIG. 8, the concealed end portion 28*a* of each member 28 subtends and is secured by welding or the like to the bottom surface 21*b* of the adjacent reinforcing element 21 of the unit 15, 16. The exposed or protruding portion 28*b* of each member is adapted to fit within a suitable pocket P formed in the end face 27 of an adjacent unit 15, 16, see FIG. 2. Member portion 28*b* is provided with an opening 28*c* which is adapted to vertically align with an opening 30 formed in the unit adjacent the end face 27 thereof when the corresponding units are in abutting end-to-end relation. As seen in FIG. 4, when openings 28*c* and 30 are in vertically aligned relation, a spike 31 is inserted through the opening and driven into a subtending shim Y and tie 13. Once the spike has been driven into the shim and tie, the corresponding gage section units are retained in abutting end-to-end relation.

The opening 30 is reinforced by a cylindrical sleeve 32 which extends substantially the full height of the reinforcing element 21. The bottom surface 21*b* of the element 21 is provided with an opening 21*c* to accommodate the shank of the spike 31.

The shank of the spike is encompassed by a resilient, compressible sleeve-like washer W which in a compressed state is disposed between an enlarged head 31*a* of the spike and the bottom surface 21*b* of the reinforcing element 21. The sleeve-like washer W serves an important function in absorbing the undulating movement of the rails and gage section units as the railway and highway traffic passes thereover and thus, prevents the spike from being pulled out of the tie.

As seen in FIG. 3, a shim Y is utilized to compensate for the difference in the total height of the rail 11 and tie plate 12 relative to the thickness of the gage section or side section units. The shim is normally formed of wood or the like and has a width comparable to the width of the tie supporting same. The ends of the shim are undercut so as not to engage the rail base section 11*c*, the tie plate 12, and the rail spike heads 14*a*.

The side section units 17, 18 are of like construction and each includes an upper lamina 33 formed of resilient moisture-proof material like that used in forming lamina 20 of units 15, 16. Subtending and secured to the underside of lamina 33 are a plurality of laterally spaced elongated reinforcing elements 34 of hollow tubular configuration. The adjacent elements 34 are separated from one another by a depending rib 33*a*. One elongated edge of lamina 33 has formed therein a lip 33*b* which is shaped so as to resiliently engage the outwardly facing portions of the rail head and web sections 11*a*, 11*b*, see FIG. 3. The elongated lip 33*b* coacts with the adjacent outer face 22 of the gage section unit 15, 16 so as to dampen any lateral vibrations caused by the railway-highway traffic, which might otherwise create loosening of the rail spikes 14 and possible enlargement of the track gage and excessive rail chatter.

In order to further dampen rail and unit vibrations caused by railway and highway traffic, a pad 35 of resilient cushioning material is interposed each reinforcing element 21 and the subtending shim Y. In the side section units 17, 18, the lamina 33 may have a portion 33*c* thereof which subtends the reinforcing elements 34. In lieu of such an arrangement, however, a pad 35 may be used to subtend each reinforcing element 34.

As aforenoted, normally more than one side section unit 17, 18 is disposed at each rail and thus, the units along each side are disposed in abutting end-to-end relation. The abutting end faces of the units are provided with interfitting male and female segments (not shown) similar to those previously described with respect to the abutting end faces of the gage section units 15, 16. In a similar manner one of the abutting end faces of each side section unit is provided with one or more anchoring tab members (not shown) and the other end face is provided with a corresponding number of pockets. The tab members and pockets are like those provided on the gage section units.

As seen in FIG. 3, the side section units 17, 18 in addition to spikes, may be retained in proper position relative to the rails by retainer boards or headers 36 which are secured to the end of the tie.

Because the highway and the track act independently in carrying their respective loads and due to the undulating movement of the track caused by railway traffic, the boards 36 preclude the loss of compacted aggregated base materials and subsequent raveling of the highway surface. Once the required number of boards 36 are in place the void between the boards and end of the highway is filled with asphaltic concrete.

In fabricating the gage section units and the side section units, the hollow reinforcing elements 21, 34 are filled with sand or some other flowable non-compressible material and then the filling end is closed or capped. The filled elements are placed in spaced parallel relation on a supporting surface and a lamina-forming sheet is placed over the elements and substantial pressure and heat is applied to effect bonding between the sheet and elements and shaping of the sheet into the desired lamina. The non-compressible material prevents the elements from being distorted or collapsed when the heat and pressure are applied to effect bonding of the elements to the underside of the lamina. Once the proper bonding has been accomplished the sand or flowable material is normally removed from the interior of the elements through an opening formed in one or both ends of each reinforcing element. Once the sand or the like is removed the openings are plugged. By having the sand or the like removed, the weight of the unit is significantly reduced thereby facilitating handling of the unit at the job site. In certain instances removal of the sand or other material may not be desired.

In installing the gage section units 15, 16 between the rails 11, one of the units is initially placed in position so that the outer face thereof contacts one side of the rail web section. The opposite or inner face portion of the unit is blocked so that it is elevated slightly with respect to the underlying shim Y. The other gage section unit is then placed next to the first unit and positioned in a similar manner so that the outer face thereof engages the web section of the opposite rail. The inner face portion of the second unit is also elevated slightly by blocking, so that the raised adjacent inner faces of the two units have the male and female segments thereof in proper aligned relation. When the blocking is subsequently removed the inner face portions will fall due to their own weight onto the subtending shim causing resilient interfitting of the male and female segments. The resilient interfitting is due to the fact that the combined widths of the adjacent units are slightly greater than the spacing between the rail web sections.

When corresponding gage section units are to be placed in abutting end to end relation, the same basic blocking procedure may be followed, except that the end faces of the corresponding units should be spaced apart a distance slightly greater than the extent to which the tab members project. After the blocking for the second set of units has been removed, the second set of units are moved endwise towards the first set of units, the latter having been preset by one or more spikes driven into place at the depressions located at approximately the midlength of the first set of units. As the second set of units are moved endwise towards the first set, the tab members 28 will be inserted into corresponding pockets. Simultaneously therewith the corresponding male and female segments will interfit with one another. Spikes 31 are then inserted into the openings 30, 21*c* and 28*c* and the leading spike end driven into the underlying shim and tie. As aforementioned, the number of sets of gage section units to be used in a crossing will depend upon the width of the highway and the shoulders associated therewith.

In positioning the side section units 17, 18, a first unit is positioned so as to be coextensive with a gage section unit. The lip 33*b* of the first side section unit snugly engages the side of the rail web section 11*b*. The side section unit is then spiked in place at approximately its mid-length. The next side section unit is then moved into proper abutting end-to-end relation with the previously positioned unit and then spiked in place.

The exposed end faces of the endmost gage section and side section units of the crossing, which extend slightly beyond the shoulders of the highway, may be covered by metallic end closures C, see FIG. 1. Each end closure has a downwardly and outwardly sloping face which communicates with the surface grooves 20*b* and directs the drainage away from the end of the crossing. A transverse french drain D or the like may be installed in or beneath the ballast or subgrade as seen in FIG. 1 so as to direct the drainage flow to an adjacent ditch line L. The end closures C may be held in place by the projecting portions 28*b* of the tab members 28 disposed at the end faces of certain units and by auxiliary tab members, not shown, which are the same shape as members 28, but are separate from the reinforcing elements. One end of each auxiliary tab member is inserted into an end face pocket P and the opposite or protruding end engages and overlies a concealed tab or flange formed at the bottom of the end closure. Other conventional means may be employed, if desired, to secure the end closures in place.

Once the gage section units and side section units have been properly positioned relative to the rails and to each other, final spiking of the units is done so that the proper positioning of the units will be retained.

Thus, it will be seen that an improved crossing has been disclosed which effectively removes surface water or the like from the exposed surface of the crossing thereby eliminating or materially reducing a potential hazard to railway and highway traffic. The improved crossing embodies a minimal number of components thereby facilitating the installation of the crossing. The components of the improved crossing permit the length of the crossing to be varied so as to accommodate highways or roadways of various sizes. The crossing has a prolonged wear life and requires minimal amount of maintenance notwithstanding varied highway and railway traffic and climatic conditions.

I claim:

1. A highway-railway crossing comprising a pair of rails, each having a base section and a head section interconnected by a web section; a plurality of spaced substantially parallel ties extending transversely of the rails and being secured thereto in subtending supporting relation; at least one pair of elongated gage section units arranged in side-by-side relation intermediate the rails, said units having corresponding elongated inner faces in abutting relation, said inner faces being resilient and engageable to form an elongated substantially moisture-proof joint therebetween, each unit having an elongated outer face disposed adjacent the web section of a rail and in substantial engagement therewith; and at least one pair of elongated side section units secured to said ties and being supported thereby, said rails and gage section units being disposed intermediate said pair of side section units, each side section unit having an elongated edge portion resiliently engaging a rail web section and coacting with the outer face of a gage section unit to resiliently sandwich the web section therebetween; the abutting inner faces of said gage section units being provided with interfitting male and female segments respectively integral with said faces that overlap along the longitudinal edges of said units, each gage section unit including a resilient moisture-proof upper lamina, and a plurality of elongated laterally spaced reinforcing elements affixed to the underside of said lamina, the exposed surface of said lamina intermediate the outer and inner faces of a unit defining a plane substantially coplanar with the upper surfaces of said rail head sections and being provided with means for effecting drainage of said exposed surface.

2. The highway-railway crossing of claim 1 wherein each gage section unit of a pair is of substantially like configuration and said units of a pair are disposed in reversed side-by-side relation, and wherein the male and female segments formed on one portion of the inner face of each gage section unit are disposed in inverted relation with respect to the segments formed on the remaining portion of said inner face.

3. The highway-railway crossing of claim 2 wherein the male and female segments formed in the inner face of each gage section unit extend from one end thereof to substantially the mid-length of said unit and then said segments are disposed in inverted relation and extend therefrom to substantially the opposite end of said inner face.

4. The highway-railway crossing of claim 2 wherein a portion of a gage section unit adjacent the outer face thereof has an upper surface provided with an elongated drain trough formed therein and recessed a substantial distance from the exposed surface of the upper lamina; said drain trough being spaced from the engagement of said unit outer face with said rail web section and being coextensive with the length of said gage section unit.

5. The highway-railway crossing of claim 2 wherein pairs of gage section units are disposed intermediate the rails and arranged in abutting end-to-end relation longitudinally of the rails; corresponding units of pairs having abutting end faces provided with complemental interfitting means for retaining said end faces in abutting relation and forming a moisture-proof joint therebetween.

6. The highway-railway crossing of claim 1 wherein the reinforcing elements are tubular and have opposite ends thereof closed; said elements being integral with the upper lamina and depending therefrom.

7. The highway-railway crossing of claim 1 including an elongated shim extending between said rails and overlying and being secured to the portion of each tie disposed intermediate the rails, said shim subtending a portion of a gage section unit; and a resilient pad interposed a reinforcing element and said shim.

8. The highway-railway crossing of claim 7 including second shims, each overlying and being secured to the portion of the tie aligned with a side section unit, and a resilient means interposed a reinforcing element of the side section unit and the shim subtending said side section unit.

9. The highway-railway crossing of claim 1 wherein the means securing said gage section and side section units to the subtending ties includes a plurality of spike-like fasteners penetrating the exposed upper surface of said lamina; each fastener having an enlarged head portion recessed from the exposed surface of said lamina, a shank projecting from the underside of said head portion and terminating within the portion of the tie aligned therebeneath, and a resilient, compressible sleeve washer disposed beneath said enlarged head portion and encompassing a portion of said shank, said washer being in a compressed state intermediate said enlarged head portion and the aligned tie portion.

10. A highway-railway crossing comprising a pair of rails, each having a base section and a head section interconnected by a web section; a plurality of spaced substantially parallel ties extending transversely of the rails and being secured thereto in subtending supporting relation; at least one pair of elongated gage section units arranged in side-by-side relation intermediate the rails, said units having corresponding elongated resilient inner faces in abutting relation and the combined width of the adjacent units, prior to assembly, being slightly greater than the spacing between said web sections of said rails so as to provide a resilient compressive fit between said units which forms an elongated substantially moisture-proof joint therebetween, each unit having an elongated outer face disposed adjacent the web section of a rail and in substantial engagement therewith; and at least one pair of elongated side section units secured to said ties and being supported thereby, said rails and gage section units being disposed intermediate said pair of side section units, each side section unit having an elongated edge portion resiliently engaging a rail web section; the abutting inner faces of said gage section units being provided with interfitting male and female segments constructed integrally with said gage section units, each gage section unit including a resilient moisture-proof upper lamina, and reinforcing means affixed to said lamina, the exposed surface of said lamina being substantially coplanar with the upper surfaces of said rail head sections and being provided with means for effecting drainage of said exposed surface.

11. In a highway crossing for a railroad wherein each of a pair of rails has a base section and a head section interconnected by a web section and wherein a plurality of spaced substantially parallel ties extends transversely of the rails and is secured thereto in subtending supporting relation, the combination comprising: at least one pair of elongated laterally-resilient gage section units adapted to be arranged in side-by-side relation intermediate the rails, said units having corresponding elongated resilient inner faces in abutting relation and the combined width of the adjacent units, prior to assembly, being slightly greater than the spacing between the web sections of said rails so as to provide a resilient compressive fit between said units which forms an elongated substantially moisture-proof joint therebetween, each unit having an elongated outer face adapted to be disposed adjacent the web section of a rail and in substantial engagement therewith, the abutting inner faces of said gage section units being provided with interfitting male and female segments respectively integral with said gage section units, each gage section unit including a resilient moisture-proof upper lamina, and reinforcing means affixed to said lamina, the exposed surface of said lamina intermediate the outer and inner surfaces of a unit defining a plane substantially coplanar with the upper surfaces of said rail head sections and being provided with means for effecting drainage of said exposed surface.

12. A highway-railway crossing comprising a pair of rails, each having a base section and a head section interconnected by a web section; a plurality of spaced substantially parallel ties extending transversely of the rails and being secured thereto in subtending supporting relation; at least one pair of elongated gage section units arranged in side-by-side relation intermediate the rails, said units having corresponding elongated inner faces in abutting relation, at least one of said faces being of resilient material so as to form an elongated substantially moisture-proof joint between said abutting faces, each unit having an elongated outer face disposed adjacent the web section of a rail and in substantial engagement therewith; and at least one pair of elongated side section units secured to said ties and being supported thereby, said rails and gage section units being disposed intermediate said pair of side section units, each side section unit having an elongated edge portion resiliently engaging a rail web section; the abutting inner faces of said gage section units being provided with male and female segments constructed unitary with said gage section units that interfit in a tongue-in-groove relationship longitudinally of said units, each gage section unit including a resilient moisture-proof upper lamina, and reinforcing means affixed to said lamina, the exposed surface of said lamina intermediate the outer and inner faces of a unit defining a plane substantially coplanar with the upper surfaces of said rail head sections and being provided with means for effecting drainage of said exposed surface.

13. In a highway crossing for a railway wherein each of a pair of rails has a base section and a head section interconnected by a web section and wherein a plurality of spaced substantially parallel ties extends transversely of the rails and is secured thereto in subtending supporting relation, the combination comprising: at least one pair of elongated gage section units adapted to be arranged in side-by-side relation intermediate the rails, said units having corresponding elongated inner faces in abutting relation, at least one of said faces being of resilient material so that an elongated substantially moisture-proof joint is formed between said faces, each unit having an elongated outer face adapted to be disposed adjacent the web section of a rail and in substantial engagement therewith; the abutting inner faces of said gage section units being provided with male and female segments that are constructed unitary with said gage section units and that interfit in a longitudinally extending tongue-in-groove relationship along the edge of said units, each gage section unit including a resilient moisture-proof upper lamina, and reinforcing means affixed to said lamina, the exposed surface of said lamina being adapted to be substantially coplanar with the upper surfaces of said rail head sections and being provided with means for effecting drainage of said exposed surface.

14. In a highway crossing for a railroad wherein each of a pair of rails has a base section and a head section interconnected by a web section and wherein a plurality of spaced substantially parallel ties extend transversely of the rails and are secured thereto in subtending supporting relation, the combination comprising: at least one pair of elongated laterally-resilient gage section units adapted to be arranged in side-by-side relation intermediate the rails, said units having corresponding elongated inner faces in abutting relation, at least one of said faces being of resilient material and the combined width of the adjacent units, prior to assembly, being slightly greater than the spacing between the web sections of said rails so as to provide, upon assembly, a resilient compressive fit between said units which forms an elongated substantially moisture-proof joint therebetween, each unit having an elongated outer face adapted to be disposed adjacent the web section of a rail and in substantial engagement therewith and an inner face provided with projecting segments constructed unitary with the gage section unit that interfit in an elongated tongue-in-groove relationship with corresponding segments of the adjacent unit of said pair, each gage section unit including a resilient moisture-proof upper lamina and reinforcing means affixed to said lamina, the exposed surface of said lamina intermediate the outer and inner surface of a unit being adapted to define a plane substantially coplanar with the upper surfaces of said rail head sections.

15. In a highway crossing for a railroad wherein each of a pair of rails has a base section and a head section interconnected by a web section and wherein a plurality of spaced substantially parallel ties extend transversely of the rails and are secured thereto in subtending supporting relation, the combination comprising: at least two pair of elongated laterally-resilient gage section units arranged in end-to-end relation, the units of each pair being arranged in side-by-side relation intermediate the rails and spanning the lateral distance between said rails, the adjacent units of each pair having corresponding elongated inner faces in abutting relation, at least one of said abutting faces being of resilient material and the combined width of a pair of laterally adjacent units, prior to assembly, being slightly greater than the spacing between the web sections of said rails so as to provide, upon assembly, a resilient compressive fit between said laterally adjacent units which forms an elongated substantially moisture-proof joint therebetween, each unit having an elongated outer face adapted to be disposed adjacent the web section of a rail and in substantial engagement therewith, the abutting inner faces of said gage section units being provided with projecting segments that are constructed unitary with said gage section units and that interfit in a longitudinal tongue-in-groove relationship with corresponding segments of the adjacent unit of said pair, each gage section unit including a resilient moisture-proof upper lamina and reinforcing means affixed to said lamina, the exposed surface of said lamina intermediate the outer and inner surfaces of a unit being adapted to define a plane substantially coplanar with the upper surfaces of said rail head sections; and the opposite end faces of each of said gage units being provided with complementary male and female end segments that interfit with the complementary end segments of longitudinally adjacent gage units to provide an overlapping, substantially moisture-proof joint between said units transverse to the rails.

* * * * *